US006650860B2

(12) United States Patent
Broddin et al.

(10) Patent No.: US 6,650,860 B2
(45) Date of Patent: Nov. 18, 2003

(54) FIXING DEVICE AND METHOD FOR TRANSFUSING TONER

(75) Inventors: Dirk Broddin, Edegem (BE); Peter Eelen, Antwerp (BE); Hans Vangenechten, Antwerp (BE); Paul Vrindts, Noorderwijk (BE)

(73) Assignee: Xeikon International N.V., Lier (BE)

( * ) Notice: Subject to any disclaimer, the term of this patent is extended or adjusted under 35 U.S.C. 154(b) by 0 days.

(21) Appl. No.: 09/976,482

(22) Filed: Oct. 11, 2001

(65) Prior Publication Data

US 2002/0090235 A1 Jul. 11, 2002

(30) Foreign Application Priority Data

Oct. 13, 2000 (GB) ..... 0025201

(51) Int. Cl.[7] ..... G03G 15/20
(52) U.S. Cl. ..... 399/307; 399/324; 430/124
(58) Field of Search ..... 399/297, 307, 399/320, 325, 324, 328, 329, 333, 338; 430/124, 105, 108.1, 126

(56) References Cited

U.S. PATENT DOCUMENTS

| | | | | |
|---|---|---|---|---|
| 5,547,742 A | | 8/1996 | Satoh et al. | |
| 5,576,818 A | | 11/1996 | Badesha et al. | |
| 5,629,761 A | * | 5/1997 | Theodoulou et al. | 399/307 |
| 5,650,253 A | * | 7/1997 | Baker et al. | 399/307 X |
| 5,805,967 A | | 9/1998 | De Bock et al. | |
| 5,893,018 A | | 4/1999 | De Bock et al. | |
| 5,968,701 A | * | 10/1999 | Onuma et al. | 430/124 X |
| 5,991,590 A | | 11/1999 | Chang et al. | |
| 6,047,156 A | | 4/2000 | De Bock et al. | |
| 6,088,565 A | * | 7/2000 | Jia et al. | 399/307 X |
| 6,141,524 A | * | 10/2000 | Berkes et al. | 399/307 |
| 6,363,236 B1 | * | 3/2002 | Ishizuka et al. | 399/325 |
| 6,385,424 B1 | * | 5/2002 | Lee et al. | 399/297 |

FOREIGN PATENT DOCUMENTS

| | | |
|---|---|---|
| EP | 0 997 794 A1 | 5/2000 |
| EP | 1004944 A1 | 5/2000 |
| EP | 1 014 220 A1 | 6/2000 |
| EP | 0 997 795 A3 | 10/2000 |
| GB | 0025200.7 | 10/2000 |
| JP | 10-161448 | 6/1998 |

* cited by examiner

*Primary Examiner*—Sandra Brase
(74) *Attorney, Agent, or Firm*—Knobbe, Martens, Olson & Bear, LLP

(57) ABSTRACT

A fixing device and method for transfusing toner on a receptor material is disclosed. Particularly, the fixing device comprises a heated transfuse member having an outermost layer of a material selected from the group of polyorganosiloxanes, fluorosilicones, fluoro-elastomers, phenylsilicones, and mixtures or hybrid compositions thereof. In operation, this outermost layer releases an amount of release agent corresponding to an amount of release agent of 0.05 mg per printed side of A4 paper or below, measured on NopaColor 100 gsm paper at an operating temperature for the transfuse member of 120 degrees Centigrade. Preferably, this outermost layer has a peel force, being measured according to Finat No. 3, with tape TESA 4163 at a peeling speed of 30 cm/min, above 7 N/m.

20 Claims, 2 Drawing Sheets

FIXING DEVICE AND METHOD FOR TRANSFUSING TONER

FIELD OF THE INVENTION

The present invention relates to an image reproduction system such as a printer or a copier and particularly to the transfuse member which is part of such a system and is intended for transfusing toner on the receptor material.

BACKGROUND OF THE INVENTION

In a typical image reproduction system such as a printing or a copying system, a latent image is formed on an image-forming member by image-wise exposure using a known graphical process. The image-forming member can be an endless member such as a drum or a belt. Typical graphical processes include amongst others magnetography, ionography, and electrography, particularly electrophotography. At present electrophotography is the most widespread. In the latter process, a charged latent image is formed on a pre-charged photosensitive member by image-wise exposure to light. The latent image is subsequently made visible on the image-forming member with charged toner at a development zone. After the development of the latent image, the developed toner image is transferred directly or via one or more intermediate transfer members to a receptor material. The receptor material can be in the form of a web or in sheet form. In the latter case, the receptor material is preferably carried on a conveyor. In general however, to enable the ability to print on a wide range of receptor materials without having to go first through an elaborate medium qualification procedure and thereafter through a demanding medium conditioning procedure, intermediate transfer members are introduced. These intermediate transfer members are usually in the form of endless belts or drums. Furthermore, where in a system without intermediate transfer members the images are first transferred to the receptor material and thereafter fused using non-contact fusing, e.g. using radiant heating, or contact fusing. In contact fusing a nip zone is usually created between the receptor material and a heated member by pressure. In this nip zone the toner images are fused to the receptor material by pressure and heating to temperatures well above 150 degrees Centigrade, usually above 170 degrees Centigrade. In systems having at least one intermediate transfer member, one can opt to simultaneously transfer and fuse the toner images to the receptor material. This principle is hereinafter referred to as transfuse, while the intermediate transfer member in contact with the receptor material is referred to as the transfuse member. The contact zone between the transfuse member and the receptor material is hereinafter referred to as the final transfer zone. A typical example of such a system is disclosed in U.S. Pat. No. 6,047,156. In a multi-color reproduction system the configuration is such that in operation the heated transfuse member carries a registered composite multi-color toner image which is subsequently transfused to the receptor material in the final transfer zone.

There are two general approaches known in the art to facilitate the transfer, more particularly the release, of the composite multi-toner image from the heated transfuse member to the receptor material. In a first approach, use is made of a release agent metering system such a system is described in EP 09977944A1, EP 0997795A3, and EP 1004944A1 (Xeikon N.V.) which are hereby incorporated by reference in order to apply typical amounts of a release agent, e.g. silicone oil, on the outermost layer of the transfuse member. In another approach, use is made of an outermost layer where the release agent is inherent or built-in, such as certain silicone layers. Particularly silicone layers with a high swelling factor are preferred as the inherent or built-in release agent in such layers can easily migrate to the outermost surface. Such a layer is e.g. described in EP1014220 (Xeikon N.V.) which is hereby incorporated by reference. Optionally, a top coating is provided on such a layer with inherent or built-in release agent provided that this top coating is permeable for this release agent. In both approaches an amount of release agent is applied to the outermost surface of the transfuse member corresponding to an amount of at least 10 mg release agent per printed A4 side of receptor material. Although the introduction of a release agent on the outermost surface of the transfuse member, according to the afore-mentioned approaches, can be beneficial for the release, it has been determined experimentally that the presence of such amounts of release agents on the transfuse member is detrimental for the print quality due to back propagation of this release agent to the photosensitive element, directly or via one or more intermediate transfer members.

SUMMARY OF CERTAIN INVENTIVE ASPECTS

One aspect of the invention includes a transfusing member that can be used in hot-pressure fixing of toner particles to a substrate while avoiding the use of substantial amounts of release agents on the surface of the transfuse member.

Another aspect of the invention includes an outermost layer for the transfuse member and a toner composition associated therewith that combine good hot offset properties with low temperature fixability, particularly for temperatures in the range from 80 to 140 degrees Centigrade.

The present invention is particularly relevant to printers and copiers where, to enable printing on a wide variety of receptor materials, at least one intermediate transfer member is provided to transfer a developed toner image from an image forming station to a receptor material. The intermediate transfer member contacting the receptor material constitutes the transfuse member referred to herein. The transfer of the developed toner image from the transfuse member to the receptor material and the simultaneous fixing thereof, hereinafter referred to as transfuse, is by means of heat and pressure. In particular, the transfuse member may be in the form of a belt or drum heated to a temperature typically in the range from 80 to 140 degrees Centigrade. The surface of the transfuse member carrying the unfixed composite toner image contacts one face of the receptor material in the final transfer nip where the toner image is transfused. In case the transfuse member is in the form of a belt, this final transfer nip may be created by feeding the heated transfuse member and the recording material simultaneously between a first guide roller contacting the back of the heated transfuse member and a second guide roller contacting the back of the receptor material while pressure is exerted on at least one of these guide rollers to define the contact. Alternately, in case the transfuse member is in the form of a drum, the final transfer nip may e.g. be created by feeding the recording material between the transfuse drum and a counter roller contacting the back of the receptor material while pressure is exerted on the drum and/or the counter roller to define the contact.

According to the present invention, a fixing device for fixing toner images onto a receptor material is disclosed comprising:

an endless transfuse member urged into contact with an endless backing member to form a final transfer zone there-between through which a receptor material path extends, said endless transfuse member having an outermost layer of a material selected from the group of polyorganosiloxanes, fluorosilicones, phenylsilicones, fluoro-elastomers, and mixtures or hybrid compositions thereof, said outermost layer having a peel force, being measured according to Finat No 3, with tape TESA 4163 at a peeling speed of 30 cm/min, above 7 N/m or from 25 N/m to 200 N/m, or from 40 to 140 N/m or from 20 N/m to 100 N/m or from 40 N/m to 100 N/m; and at least one heating device for heating said endless transfuse member to a temperature from 80 to 140 degrees Centigrade.

The fixing device may further comprise a release agent metering system contacting said outermost layer of said transfuse member for applying an amount of release agent on the outermost surface of said outermost layer corresponding to an amount of 0.5 mg per side A4 of paper or below. The release agent can be a silicone oil or more preferably a functional oil can be used as e.g. disclosed in U.S. Pat. No. 5,576,818.

Further according to the present invention, a method is disclosed for fixing unfixed toner images on a receptor material, comprising the steps of:

heating unfixed toner images on an endless transfuse member to a temperature from 80 to 140 degrees Centigrade, said transfuse member having an outermost layer of a material selected from the group of polyorganosiloxanes, fluorosilicones, fluoro-elastomers, phenylsilicones, and mixtures or hybrid compositions thereof, said outermost layer releasing an amount of release agent corresponding to an amount of release agent of 0.05 mg per printed side of A4 paper or below, measured on NopaColor 100 gsm paper at an operating temperature for the transfuse member of 120 degrees Centigrade; and transfusing said heated toner images to a surface of a receptor material by urging said endless transfuse member against an endless counter member while said receptor material is fed there-between. Preferably, the outermost layer has a peel force, being measured according to Finat No. 3, with tape TESA 4163 at a peeling speed of 30 cm/min, above 7 N/m.

Preferably the transfuse member is heated internally, e.g. by using at least one heating roller or at least one heating lamp. Additionally or alternatively, a radiant heating device may be provided to heat the composite toner image on the transfuse member in advance of the final transfer zone. It may be advantageous to heat the transfuse member to a uniform temperature. By a uniform temperature a maximum temperature drop of 30% during one cycle of the transfuse member is meant. The composite toner image may be formed of toner particles from a dry or a liquid developer. In the latter case the developed toner images may be compacted before being transferred to the transfuse member.

In an embodiment of the invention the outermost layer of the transfuse member is a polyorganosiloxane or a fluorosilicone with a swelling factor SF of 2 or below, preferably 1.5 or below, and more preferably 1.3 or below.

In another embodiment of the invention the outermost layer of the transfuse member is a phenylsilicone, or a fluoro-elastomer, or a fluorocarbon with a swelling factor SF of 1.3 or below.

In another embodiment of the invention, the transfuse member carries a multi-color composite toner image in advance of the final transfer zone. A color is defined as a pigment such as e.g. cyan, magenta, yellow, red, green, blue and includes black. The toner particles of said composite toner image have a Storage modulus, G' from 5000 to 15000 Pa when measured at a temperature of 125 degrees Centigrade and a frequency of 16 Hz. More preferably, the toner particles have a melt viscosity from 10 to 500 Pa s measured at 100 rad/s at 120 Centigrade degrees.

In a further embodiment of the invention, unfixed toner particles in image form are carried on the transfuse member and are transferred to the receiving material and fixed thereon as the receiving material passes through the final transfer zone. The unfixed toner particles may be deposited upon the transfuse member by any means known in the art, such as described in U.S. Pat. No. 5,805,967 (De Bock et al./Xeikon NV) which is hereby incorporated by reference.

In case the transfuse member is a belt, this belt preferably comprises an electrically conductive backing member covered with the outermost layer according to the present invention. Alternatively at least one layer may be provided between said backing member and said outermost layer particularly for reasons of conformability. This layer can be composed of e.g. a silicone elastomer, polytetrafluoroethylene, fluorosilicones, polyfluoralkylene or other fluorinated polymers. This layer may be doped with electrical or thermal conductive fillers. The total thickness of the transfuse member may range between 0.15 and 1.5 mm, or for reasons of conformability between 0.4 and 1.5 mm.

The electrically conductive backing member may be composed of a metal such as e.g. stainless steel. Alternatively, an optionally reinforced or pre-stressed fabric backing member may be used.

The receptor material can be in web form or in sheet form. In the latter case, the receptor material is preferably transported on a conveyor. Typical receptor materials are papers, films, label stock, cardboard etc.

DETAILED DESCRIPTION OF CERTAIN EMBODIMENTS OF THE INVENTION

Figure 1:
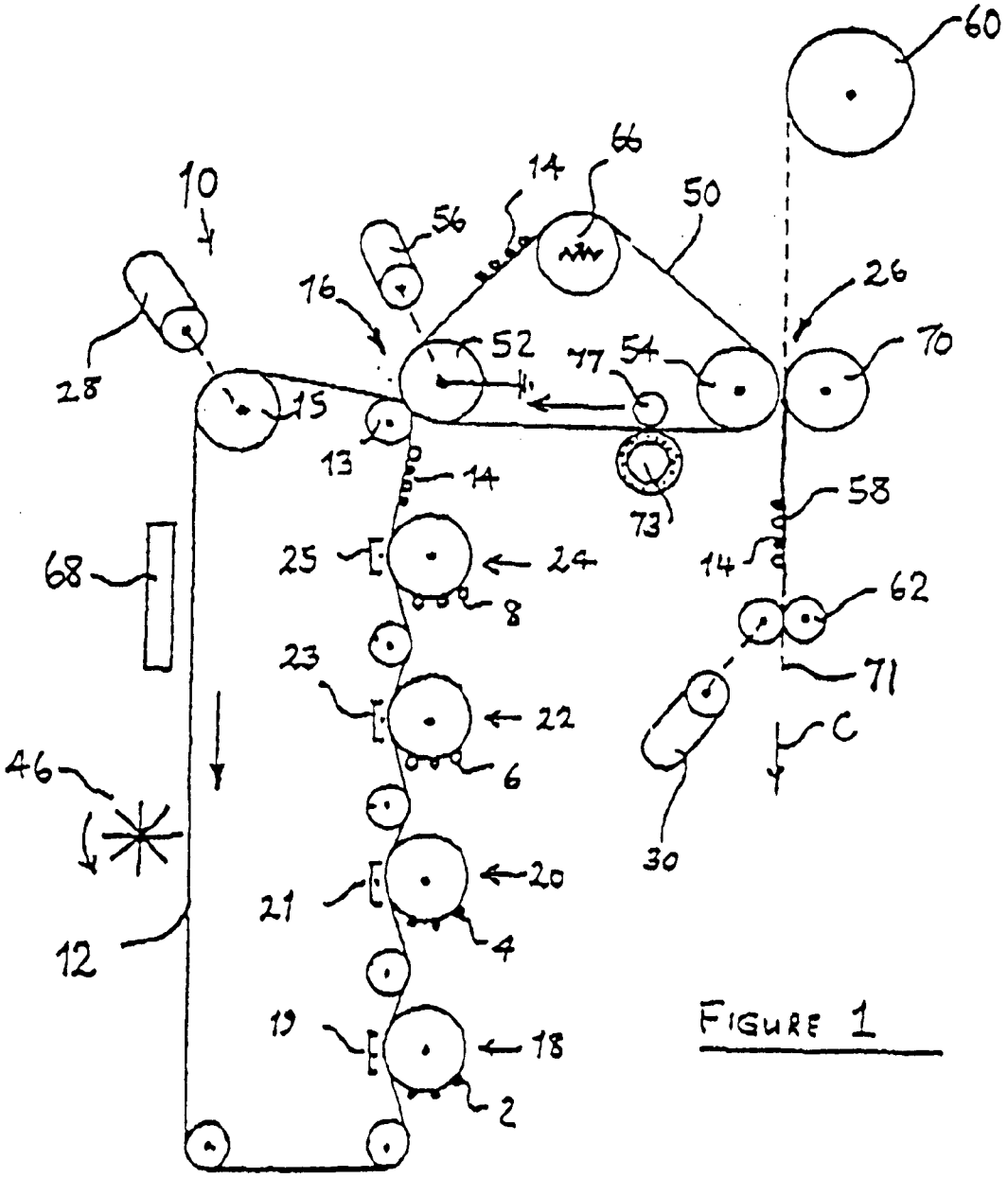
FIG. 1 shows a schematic representation of a printer having a fixing device according to an embodiment of the invention.

In relation to the appended drawings, the present invention is described in detail as follows. It is apparent however that a person skilled in the art can imagine several other equivalent embodiments or other ways of executing the present invention, the spirit and scope of the present invention being limited only by the terms of the appended claims.

In a multi-color image reproduction system the configuration is such that in operation the transfuse member, which is heated to a temperature from 80 to 140 degrees Centigrade, carries a registered composite multi-color toner image which is subsequently transfused to the receptor material in the final transfer zone. There are several advantages in limiting the temperature of the transfuse member to 140 degrees Centigrade or below. At first this limits the total amount of power required to heat the transfuse member, which is beneficial for both environmental and economical reasons. Moreover, as the transfer member not only contacts the receptor material but also contacts an image delivering member, this low temperature transfuse concept is also beneficial with respect to the potential cooling of the image delivering member and/or the transfuse member as the need for the fixing may be obviated or be at least less demanding. Cooling may be necessary in such system to avoid warming up of the image-forming member. The image delivering member may be constituted by an image forming member, such as e.g. a photosensitive member, or by a an intermediate transfer member which may on its turn contact an image forming member. The use of such an intermediate transfer member is definitely beneficial in buffering the transfuse member from the image forming member. The use of fairly low temperatures is not necessary detrimental with respect to gloss. Even if the transfused toner images on the receptor material do not have the desired level of gloss, gloss can be further tuned in a gloss enhancement module which allows operators to optionally choose high or low gloss print output.

As stated before, to avoid back propagation of release agent to the image-forming member(s) and because the material properties of the materials with inherent or built-in release agent can degrade substantially over time, according to the present invention, the transfuse should be substantially dry. Substantially dry means that the total amount of release agent present on the outermost surface of the transfuse member is at maximum an amount which corresponds to an amount present to the printed paper of NopaColor 100 gsm as available from UPM Kymmene of 0.5 mg per paper side A4 or below, or more preferably to an amount of 0.1 mg per paper side A4 or below, or even more preferably to an amount of 0.05 mg per paper side A4 or below. These numbers correspond to an operating temperature of 120 degrees Centigrade for the transfuse member. Consequently this puts severe restrictions on the materials which can be used as the outermost layer of the transfuse member as these materials may not rely on inherent or built-in release agent. The outermost layer has to be substantially impermeable for release agents, particularly silicone oils.

The surface properties of the outermost layer of the fixing member, i.e. the top layer and particularly the adhesion are of major importance. A quantity used to characterize adhesion is the peeling force. The peeling force is determined according to the Finat No. 3 norm, using Tape TESA 4163 as available from TESA TAPE, Inc. located in Charlotte, N.C. and is defined as the force required to peel the TESA 4163 tape away from the outermost surface of a layer at an angle of 180° and a speed of 30 cm/min.

The outermost layer of the present invention is preferably composed of a material selected from the group of polyorganosiloxanes, fluorosilicones, phenylsilicones fluoro-elastomers, and mixtures or hybrid compositions thereof, said outermost layer having a peel force, being measured according to Finat No 3, with tape TESA 4163 at a peeling speed of 30 cm/min, above 7 N/m. The peel tests are always performed on pristine materials, i.e. materials which where did not yet carry toner. As these materials have a high adhesion, to avoid splitting up of the toner layer the cohesion of the toner has to be sufficiently high at the temperature range of interest. This problem is even more stringent if there is a pile of toner particles such as in a composite multi-color toner image of a multi-color image reproduction system. It is experimentally observed that one needs a toner with an elasticity being parameterized by the storage modulus G' from 5000 to 15000 Pa. G' is measured at a temperature of 125 degrees Centigrade and at a frequency of 16 Hz. Apart from a high elasticity in the temperature range of interest, the toner particles preferably originate from a toner composition having a sufficiently low melt viscosity. The melt viscosity is typically from 50 to 1000 Pa s or from 10 to 500 Pa s measured at 100 rad/s at 120 Centigrade degrees. A toner with such melt viscosity can easily penetrate into the receptor material at the applied pressure and thereby maximize the contact area, which is beneficial for the transfer.

Surprisingly there exist a toner composition with such visco-elastic properties which combined with an adhesive outermost layer of the transfuse member gives transfuse results in the temperature range from 80 to 140 degrees Centigrade.

An example of such a toner is described in the co-pending application as of the same date and assigned to the same assignee, which is hereby entirely incorporated by reference (TRANSFIXTON, GB application No. 0025200.7 filed on Oct. 13, 2000). Knowing that the elasticity degrades severely with increasing temperature and knowing that one needs a sufficiently low melt viscosity toner in order to give a good release on a highly adhesive outermost layer of the transfuse member, it is believed that it is nearly impossible to prepare a toner composition with about the same elasticity above 140 degrees Centigrade.

It is experimentally observed, particularly for silicone based materials, that the oozing out of silicone oil inherently present or built-in in layers of such materials is closely related to the swelling factor, as also disclosed in EP 1014220. The higher the swelling factor, the more easily the silicone oil migrates to the surface of the outermost layer. In such materials swelling is to a certain extent correlated with adhesion and thus with the peel force. The swelling factor is measured preferably on a pristine sample or in case of a used sample the sample is first immersed for two hours in a bath filled with toluene and dried thereafter. The sample is a self-supporting sample of the outermost layer measuring about 20 mm by 3 mm which thickness is measured to an accuracy of 0.1 $\mu$m. This is the value Thd, standing for dry thickness. Afterwards the self-supporting sample is wetted with toluene and the sample is allowed to swell for 3 minutes, then the excess toluene is wiped and the thickness of the swollen sample is again measured to an accuracy of 0.1 $\mu$m. This is the value Thw. The swelling factor, SF, is Thw/Thd.

When the outermost layer of the transfuse member is a polyorganosiloxane or a phenylsilicone or a fluorosilicone the swelling factor SF has to be 2 or below, preferably 1.5 or below, and more preferably 1.3 or below. When the outermost layer of the transfuse member is a phenylsilicone, or a fluoro-elastomer, or a fluorocarbon the swelling factor SF has to be 1.3 or below.

EXAMPLES a) FE123, which is the Trade name for a fluorosilicone material of Shin-Etsu; this material has a peel force being measured according to Finat No 3, with tape TESA 4163 at a peeling speed of 30 cm/min, of 90 N/m and a swelling factor SF of 1.2. This material is suited for use as outermost layer for the transfuse member.

b) FSR2000, which is the Trade name for a fluorosilicone material of General Electric; this material has a peel force being measured according to Finat No 3, with tape TESA 4163 at a peeling speed of 30 cm/min, of 7 N/m. This material is unsuited for use as outermost layer for the transfuse member.

c) TEFLON, which is a trade name for PTFE; this material has a peel force being measured according to Finat No 3, with tape TESA 4163 at a peeling speed of 30 cm/min, of 45 N/m and virtually no swelling. This material can be used as outermost layer for the transfuse member provided that this layer is thin enough for reasons of conformability.

d) RHODORSIL, which is a trade name for a polyorganosiloxane of Rhone Poulenc; this material has a peel force being measured according to Finat No 3, with tape TESA 4163 at a peeling speed of 30 cm/min, of 5.5 N/m and has a swelling factor SF of 2.3. In operation, this material releases an amount of silicone oil on the surface of the transfuse member corresponding to an amount of oil of more than 2 mg per paper side A4. This material is unsuited for use as an outermost layer for the transfuse member.

At first sight, the use of highly adhesive materials for the outermost layer of the transfuse member could seem to be a bad choice with respect to friction as such materials are often high friction materials. There are however solutions known in the art to lower the friction as e.g. disclosed in U.S. Pat. No. 5,547,742 where PTFE is incorporated in the fluorosilicone for long durability and reduced friction.

The printer 10 shown in FIG. 1 comprises a primary transfer belt 12 formed of polyimide having a thickness of 100 $\mu$m and having spaced along one run thereof a plurality of toner image-forming stations 18, 20, 22, 24. Each of these stations is similar to those described in U.S. Pat. No. 5,893,018, and includes a corona discharge unit 19, 21, 23, 25 to electrostatically deposit a plurality of developed toner images 2, 4, 6, 8 in register with each other onto the primary transfer belt 12 to form a multiple toner image 14 thereon.

The primary transfer belt 12 passes over a number of guide rollers, including a nip-forming guide roller 13 and a drive roller 15 driven by a motor 28. The primary transfer belt 12 is continuously driven in turn through the image-forming stations 18, 20, 22, 24, through an intermediate transfer nip 16, through a cooling station 68 and through a cleaning station 46.

The intermediate transfer nip 16 is formed between the guide roller 13 and an earthed guide roller 52, through which nip the primary transfer belt 12 and a transfuse belt 50 pass in intimate contact with each other.

The transfuse belt 50 is driven by a motor 56 continuously in turn through the intermediate transfer nip 16, over a heated roller 66 through a final transfer zone 26. The heated roller 66 is positioned after the intermediate transfer nip 16 and before the final transfer zone 26.

The final transfer zone 26 is formed between a guide roller 54 of the transfuse belt 50 and a counter roller 70, through which zone the transfuse belt 50 and a receptor material in the form of a paper web 58 pass in intimate contact with each other. Drive rollers 62, driven by a motor 30, drive the web 58 along a paper web path 71 in the direction of the arrow C from a supply roll 60 continuously through the final transfer zone 26 where it is pressed against the transfuse belt 50 by the counter roller 70.

Figure 2:
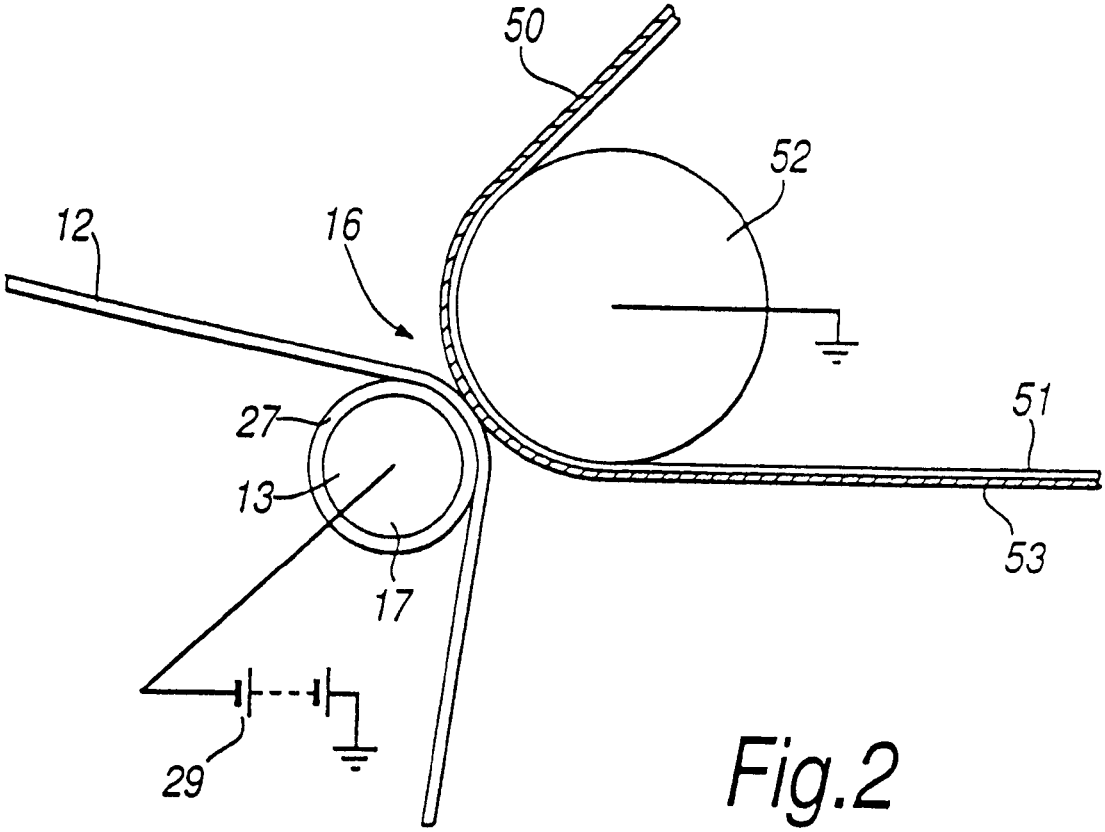
FIG. 2 is an enlarged view of a part of the printer shown in FIG. 1.

As seen more clearly in FIG. 2, the intermediate transfer nip 16 is formed between the guide roller 13 and an opposing guide roller 52 pressed towards each other to cause tangential contact between said primary transfer belt 12 and the transfuse belt 50.

The first guide roller 13 comprises an electrically conductive core 17 carrying a semi-insulating covering 27. A supply 29 of electrical potential is provided for electrically biasing the first guide roller 13 to create an electrical field at the intermediate transfer nip 16 to assist in transferring the image 14 from the primary belt 12 to the transfuse belt 50.

To adjust this pressure at the intermediate transfer nip 16, the guide roller 13 is movably mounted, to enable it to be adjusted towards or away from the guide roller 52.

The transfuse belt 50 is formed with an electrically conductive metal backing 51 having a thickness of between 50 and 150 $\mu$m, such as 75 $\mu$m stainless steel or 100 $\mu$m nickel. The backing is covered with a layer 53 of fluorosilicone with a thickness of 170 $\mu$m. The fluorosilicone used is FE123 of Shin-Etsu. This material has a peel force being measured according to Finat No 3, with tape TESA 4163 at a peeling speed of 30 cm/min, of 90 N/m and a swelling factor SF of 1.2.

The printer is used as follows.

The primary transfer belt 12 carrying the multiple toner image 14 contacts the heated transfuse member 50 at the intermediate transfer nip 16 to electrostatically transfer the multiple toner image 14 to the transfuse belt 50. The pressure exerted between the first guide roller 13 and the second guide roller 52 at the intermediate transfer nip 16 is about 100 N.

The transfuse belt 50, with the multiple toner image carried thereon, is heated by heated roller 66 to a temperature of between 80° and 140° C., such as about 125° C., thereby to render the multiple toner image tacky.

The transfuse belt 50 carrying the tacky multiple toner image 14 then contacts the web 58 at the final transfer zone 26 to transfer the multiple toner image 14 thereto.

The transfuse belt 50 is then brought into further contact with the primary transfer belt 12 while transfuse belt 50 is at an elevated temperature to establish a temperature gradient at said intermediate transfer nip 16. The temperature of the transfuse belt 50 immediately upstream of said intermediate transfer nip 16 is about 115° C., the temperature of the primary belt 12 immediately upstream of said intermediate transfer nip 16, is about 35° C. The temperature of the transfuse belt 50 falls only slightly as the belt passes through the nip, with the result that immediately upstream of the heating device 66 the temperature is about 100° C. The heating device 66 needs only to raise the temperature of the transfuse belt by about 25 Centigrade degrees to bring the toner image thereon to the required temperature for final transfer. In this configuration the heating takes place on the inside of the belt so that the outermost layer of the transfused member is not exposed to extreme temperatures. By doing so oxidative degradation of the outermost layer can be avoided.

The primary transfer belt 12 is forcibly cooled at the cooling station 68 by directing cooled air onto the primary transfer belt 12. The primary transfer belt 12 is thereby cooled to the temperature of about 35° C. This cooling assists in establishing the required temperature gradient at the intermediate transfer nip 16.

The primary transfer belt 12 is cleaned at cleaning station 46 before the deposition of further developed toner images 2, 4, 6, 8.

The transfuse belt 50 is urged into contact with the counter roller 70 to form the final transfer zone 26 through which the path 71 for the paper web 58 extends. Unfixed toner particles 14, which have been deposited onto the transfuse belt 50 in image form by the printer upstream of the fixing nip 26, are transferred to the paper web 58 and fixed thereon as the paper web 58 passes through the fixing nip 26. The transfer belt 50 has a substantially dry outer layer 53 of FE123 of Shin-Etsu and passes over a roller 54 at the final transfer zone 26.

A cleaning roller 73 has its surface in rolling contact with the surface of the transfuse belt 50 to remove contaminants (including residual toner) therefrom. The cleaning roller 73 comprises a rigid metal core provided with a conformable EPDM covering. The conformable covering has a hardness of 60 Shore A and a thickness of 5 mm. A radiant heater may be positioned adjacent the cleaning roller.

What is claimed is:

1. A fixing device for fixing toner images onto a receptor material, comprising:

an endless transfuse member urged into contact with an endless backing member to form a final transfer zone there-between through which a receptor material path extends, said endless transfuse member having an outermost layer of a material selected from a group consisting of polyorganosiloxanes, fluorosilicones, fluoro-elastomers, phenylsilicones, and mixtures or hybrid compositions thereof, and wherein said outermost layer has an initial peel force, being measured according to Finat No 3, with tape TESA 4163 at a peeling speed of 30 cm/mm, from 40–140 N/in; and at least one heating device for heating said endless transfuse member to a temperature from 80 to 140 degrees Centigrade.

2. The fixing device as recited in claim 1, further comprising a release agent metering system contacting said outermost layer of said transfuse member for applying an amount of release agent on the outermost surface of said outermost layer corresponding to an amount of 0.5 mg per side A4 of paper or below, measured on NopaColor 100 gsm paper at an operating temperature for the transfuse member of 120 degrees Centigrade.

3. The fixing device as recited in claim 2, wherein said release agent is a silicone oil or a functionalised silicone oil.

4. The fixing device as recited in claim 1, wherein said material of said outermost layer has a swelling factor, SF, of 2 or below.

5. The fixing device as recited in claim 1, wherein no release agent is applied to said endless transfuse member.

6. A fixing device for fixing toner images onto a receptor material, comprising:

an endless transfuse member urged into contact with an endless backing member to form a final transfer zone there-between through which a receptor material path extends, said endless transfuse member having an outermost layer of fluorosilicone, and wherein said outermost layer has an initial peel force, being measured according to Finat No 3, with tape TESA 4163 at a peeling speed of 30 cm/mm, from 40–140 N/m; and at least one heating device for heating said endless transfuse member to a temperature from 80 to 140 degrees Centigrade.

7. The fixing device as recited in claim 6, wherein no release agent is applied to said endless transfuse member.

8. A method of fixing unfixed toner images on a receptor material, comprising:

heating unfixed toner images on an endless transfuse member to a temperature from 80 to 140 degrees Centigrade, said transfuse member having an outermost layer of a material selected from a group consisting of polyorganosiloxanes, fluorosilicones, fluoro-elastomers, phenylsilicones, and mixtures or hybrid compositions thereof, and wherein said outermost layer has an initial peel force, being measured according to Finat No 3, with tape TESA 4163 at a peeling speed of 30 cm/mm, from 40–140 N/in; and transfusing said heated toner images to a surface of a receptor material by urging said endless transfuse member against an endless counter member while said receptor material is fed there-between.

9. The method as recited in claim 8, wherein said material of said outermost layer has a swelling factor, SF, of 2 or below.

10. The method as recited in claim 8, wherein said unfixed toner images are composed of toner particles having a storage modulus, G', from 5000 to 15000 Pa, G' being measured at a temperature of 125 degrees Centigrade and at a frequency of 16 Hz.

11. The method as recited in claim 8, wherein no release agent is applied to said endless transfuse member.

12. A method of fixing unfixed toner images on a receptor material, comprising:

heating unfixed toner images on an endless transfuse member to a temperature from 80 to 140 degrees Centigrade, said transfuse member having an outermost layer of fluorosilicone, and wherein said outermost layer has an initial peel force, being measured according to Finat No 3, with tape TESA 4163 at a peeling speed of 30 cm/min, from 40–140 N/m; and transfusing said heated toner images to a surface of a receptor material by urging sad endless transfuse member against an endless counter member while said receptor material is fed there-between.

13. The method as recited in claim 12, wherein no release agent is applied to said endless transfuse member.

14. A method for fixing unfixed toner images on a receptor material, comprising:

heating unfixed toner images on an endless transfuse member to a temperature from 80 to 140 degrees Centigrade, said transfuse member having an outermost layer of a material selected from a group consisting of polyorganosiloxanes, fluorosilicones, fluoro-elastomers, phenylsilicones, and mixtures or hybrid compositions thereof, said outermost layer releasing an amount of release agent corresponding to an amount of release agent of 0.05 mg per printed side of A4 paper or below, measured on NopaColor 100 gsm paper at an operating temperature for the transfuse member of 120 degrees Centigrade; and transfusing said heated toner images to a surface of a receptor material by urging said endless transfuse member against an endless counter member while said receptor material is fed there-between.

15. The method as recited in claim 14, wherein said outermost layer has a peel force, being measured according to Finat No. 3, with tape TESA 4163 at a peeling speed of 30 cm/min, above 7 N/m.

16. The method as recited in claim 15, wherein said outermost layer has a peel force, being measured according to Finat No. 3, with tape TESA 4163 at a peeling speed of 30 cm/min, from 25 to 200 N/m.

17. The method as recited in claim 14, wherein said material of said outermost layer has a swelling factor, SF, of 2 or below.

18. The method as recited in claim 14, wherein said unfixed toner images are composed of toner particles having a storage modulus, G', from 5000 to 15000 Pa, G' being measured at a temperature of 125 degrees Centigrade and at a frequency of 16 Hz.

19. A method for fixing unfixed toner images on a receptor material, comprising:

heating unfixed toner images on an endless transfuse member to a temperature from 80 to 140 degrees Centigrade, said transfuse member having an outermost layer of fluorosilicone, said outermost layer releasing an amount of release agent corresponding to an amount of release agent of 0.05 mg per printed side of A4 paper or below, measured on NopaColor 100 gsm paper at an operating temperature for the transfuse member of 120 degrees Centigrade; and transfusing said heated toner images to a surface of a receptor material by urging said endless transfuse member against an endless counter member while said receptor material is fed there-between.

20. The method as recited in claim 19, wherein said outermost layer has a peel force, being measured according to Finat No. 3, with tape TESA 4163 at a peeling speed of 30 cm/min, above 7 N/m.

* * * * *